US009878724B2

(12) United States Patent
Evans et al.

(10) Patent No.: US 9,878,724 B2
(45) Date of Patent: Jan. 30, 2018

(54) TRACTION ASSIST FOR RAILCAR MOVER

(71) Applicant: Trackmobile LLC, La Grange, GA (US)

(72) Inventors: Robert Evans, LaGrange, GA (US); Jeffrey Looney, LaGrange, GA (US); Allan Draheim, LaGrange, GA (US)

(73) Assignee: Trackmobile LLC, La Grange, GA (US)

( * ) Notice: Subject to any disclaimer, the term of this patent is extended or adjusted under 35 U.S.C. 154(b) by 0 days.

(21) Appl. No.: 15/154,553

(22) Filed: May 13, 2016

(65) Prior Publication Data

US 2017/0043793 A1 Feb. 16, 2017

Related U.S. Application Data

(60) Provisional application No. 62/204,198, filed on Aug. 12, 2015.

(51) Int. Cl.

| | |
|---|---|
| ***B61C 11/00*** | (2006.01) |
| ***F03G 7/08*** | (2006.01) |
| ***B60F 1/04*** | (2006.01) |
| ***B60P 1/52*** | (2006.01) |
| ***B60F 1/00*** | (2006.01) |
| ***A47C 19/20*** | (2006.01) |
| ***B61B 13/00*** | (2006.01) |
| ***B61F 1/06*** | (2006.01) |

(52) U.S. Cl.

CPC ..... *B61C 11/00* (2013.01); *B61F 1/06* (2013.01)

(58) Field of Classification Search

CPC . B61C 11/00; E01H 8/105; F03G 7/08; B60F 1/04; B60F 1/043; B60F 1/00; A47C 19/20; B61B 13/00; B62D 7/142; B60P 1/52

See application file for complete search history.

(56) References Cited

U.S. PATENT DOCUMENTS

| | | | | |
|---|---|---|---|---|
| 2,006,781 A * | 7/1935 | Winkley | B60F 1/043 105/72.2 |
| 3,002,469 A * | 10/1961 | Wanner | B60F 1/00 105/159 |
| 3,019,742 A * | 2/1962 | Kershaw | B60F 1/00 105/177 |
| 3,875,870 A * | 4/1975 | Beatty | B60F 1/00 105/215.2 |
| 4,077,532 A * | 3/1978 | Bryan | B60P 1/52 108/55.3 |
| 6,494,144 B1 * | 12/2002 | Perez Sanchez | F03G 7/08 104/287 |

(Continued)

*Primary Examiner* — Yuri Kan

(74) *Attorney, Agent, or Firm* — Banner & Witcoff, Ltd.

(57) ABSTRACT

An auxiliary drive axle assembly is disclosed for a railcar mover that provides traction for a railcar mover when required. The auxiliary drive axle assembly comprises a frame, a plurality of hydraulic motors, and a plurality of wheel assemblies positioned underneath a railcar mover. The auxiliary drive axle assembly may be lowered to a use position where the wheels engage the rails either upon demand by the railcar mover operator or automatically by a control system based upon a set of monitored parameters. When in a use position, the control system directs the power to the hydraulic motors such that the wheel assemblies can have optimal traction to assist the railcar mover.

16 Claims, 5 Drawing Sheets

(56) References Cited

U.S. PATENT DOCUMENTS

| | | | | |
|---|---|---|---|---|
| 2005/0204949 | A1* | 9/2005 | Jacob | B60F 1/04 105/72.2 |
| 2006/0180375 | A1* | 8/2006 | Wierzba | B62D 7/142 180/253 |
| 2014/0159410 | A1* | 6/2014 | Rasmussen | A47C 19/20 296/24.33 |
| 2015/0053109 | A1* | 2/2015 | Bramlett | E01H 8/105 104/279 |
| 2016/0272222 | A1* | 9/2016 | Katahira | B61B 13/00 |

* cited by examiner

TRACTION ASSIST FOR RAILCAR MOVER

RELATED APPLICATIONS

This present application claims the benefit to U.S. Provisional Patent Application No. 62/204,198 filed on Aug. 12, 2015 which is incorporated by reference herein and made a part hereof.

FIELD OF INVENTION

The field of invention for this disclosure relates to a device for improving traction for railcar movers.

BACKGROUND

Railcar movers provide a more efficient way to move railcars around within a rail yard than using a locomotive for such tasks. Being smaller than locomotives, railcar movers can sometimes develop problems getting proper traction. If the traction is improved, the railcar mover may be able to move additional railcars without increasing the size of the power source of the original railcar mover.

Some approaches to increase traction have been to add additional weight or ballast to the railcar mover, but increasing the weight, while improving traction does not improve efficiency. An apparatus to increase the traction of the railcar mover without appreciably increasing the overall weight of the railcar mover would lead to improved efficiency of the railcar mover.

SUMMARY

Aspects of this disclosure relate to an auxiliary drive axle assembly for a railcar mover comprising: a structural frame, a plurality of hydraulic wheel drive motors, a plurality of wheel assemblies, a plurality of gearboxes; wherein the auxiliary drive axle assembly is positioned underneath the railcar mover and provides traction assistance to the railcar mover by being lowered from a retracted position to a use position, wherein the retracted position is defined with the plurality of wheel assemblies not engaging a set of rails and the use position is defined with the plurality of wheel assemblies engaging the set of rails. An outer diameter of each of the plurality of wheel assemblies may be within a range of 24 inches to 38 inches. Each wheel assembly may be powered by one of the plurality of hydraulic wheel drive motors where each hydraulic wheel drive motor may be connected to the power source of the railcar mover. The plurality of hydraulic wheel drive motors may be powered by the engine of the railcar mover. The auxiliary drive axle assembly may include a control system comprising a controller and a plurality of sensors to control the auxiliary drive axle assembly. The wheel assemblies may enter a freewheeling condition when a user applies the brakes of the railcar mover. Lastly, the auxiliary drive axle assembly may be lowered from a retracted position underneath the railcar mover using a pump supply from a hydraulic system from the railcar mover.

Other aspects of this disclosure may relate to a non-transitory computer readable medium storing computer readable instructions that, when executed by the controller, may cause the controller to at least: acquire a first set of data comprising: engine revolutions per minute; compare the first set of data to a first set of predetermined parameters; and upon determining that first set of predetermined parameters is satisfied, lower the auxiliary drive axle assembly into a use position from a retracted position underneath the railcar mover, where the first set of predetermined parameters may include designated target values of at least engine revolutions per minute. The non-transitory computer readable medium stores computer readable instructions that, when executed by the controller, may further cause the controller to at least: upon lowering the auxiliary drive axle assembly into a use position; acquire a second set of data including engine revolutions per minute; compare from the second set of data to a second set of predetermined parameters; and determine the proper force to be applied to the plurality of hydraulic wheel drive motors in order to achieve optimal traction. In addition, the non-transitory computer readable medium stores computer readable instructions that, when executed by the controller, may further cause the controller to at least: upon lowering the auxiliary drive axle assembly into a use position; acquire a third set of data including engine revolutions per minute; compare the third set of data to a third set of predetermined parameters; and upon determining that the third set of predetermined parameters are satisfied, instruct to retract the auxiliary drive axle assembly to a nonuse state underneath the railcar mover. The third set of predetermined parameters may include designated target values of at least engine revolutions per minute. Also, the first, second, and third set of data may comprise: a torque converter revolutions per minute, a driving torque, input from a braking system, and input from a traction control wheel.

Still other aspects of this disclosure may relate to an auxiliary drive axle assembly for a railcar mover comprising: a structural frame having a first end and a second end and a plurality of side walls positioned between each end, a first hydraulic wheel drive motor, a first gearbox, and a first wheel assembly positioned at the first end of the structural frame; a second hydraulic wheel drive motor, a second gearbox, and a second wheel assembly positioned at the second end of the structural frame. The first wheel assembly may be connected to the first hydraulic wheel drive motor via the gearbox; and the second wheel assembly may be connected to the second hydraulic wheel drive motor via the second gearbox. The auxiliary drive axle assembly may be positioned underneath the railcar mover. A portion of the first gearbox may be positioned within the diameter of the first wheel assembly. An outer diameter of each of the first wheel assembly may be within a range of 24 inches to 38 inches. A plurality of wear guides may be positioned on an exterior surface of the plurality of side walls of the structural frame and wherein the wear guides are replaceable. The first wheel assembly may comprise: a first wheel on the interior and a first tire positioned on the exterior of the first wheel assembly, where the first tire may include a taper on an exterior surface, and the second wheel assembly may comprise: a second wheel on the interior and a second tire positioned on the exterior of the second wheel assembly, where the second tire may include a taper on an exterior surface. The first wheel assembly may be powered by the first hydraulic wheel drive motor, and the second wheel assembly may be powered by the second hydraulic wheel drive motor, and where the first hydraulic wheel drive motor and the second hydraulic wheel drive motor may be connected to the power source of the railcar mover. The first gearbox and the second gearbox may be planetary-type gearboxes. The auxiliary drive axle assembly may include a control system comprising a controller and a plurality of sensors to control the auxiliary drive axle assembly.

Yet another aspect of this disclosure may relate to an auxiliary drive axle assembly for a railcar mover comprising: a structural frame having a first end and a second end and a plurality of side walls positioned between each end, a first hydraulic wheel drive motor, a first gearbox, and a first wheel assembly positioned at the first end of the structural frame; a second hydraulic wheel drive motor, a second gearbox, and a second wheel assembly positioned at the second end of the structural frame, and a control system comprising a controller and a plurality of sensors to control the auxiliary drive axle assembly. An outer diameter of each of the plurality of wheel assemblies may be within a range of 24 inches to 38 inches; and the auxiliary drive axle assembly may be positioned underneath the railcar mover. The first wheel assembly may be powered by the first hydraulic wheel drive motor, and the second wheel assembly may be powered by the second hydraulic wheel drive motor, and where the first hydraulic wheel drive motor and the second hydraulic wheel drive motor may be connected to the power source of the railcar mover. The auxiliary drive axle assembly for a railcar mover may further comprise: a non-transitory computer readable medium storing computer readable instructions that, when executed by the controller, causes the controller to at least: acquire a first set of data comprising: engine revolutions per minute; compare the first set of data to a first set of predetermined parameters; upon determining that first set of predetermined parameters is satisfied, lower the auxiliary drive axle assembly into a use position from a retracted position underneath the railcar mover. In addition, the non-transitory computer readable medium stores computer readable instructions that, when executed by the controller, further causes the controller to at least: upon lowering the auxiliary drive axle assembly into a use position; acquire a second set of data including engine revolutions per minute; compare from the second set of data to a second set of predetermined parameters; determine the proper force to be applied to the plurality of hydraulic wheel drive motors in order to achieve optimal traction. Lastly, the non-transitory computer readable medium stores computer readable instructions that, when executed by the controller, may further cause the controller to at least: upon lowering the auxiliary drive axle assembly into a use position; acquire a third set of data including engine revolutions per minute; compare from the third set of data to a third set of predetermined parameters; upon determining that the third set of predetermined parameters are satisfied, instruct to retract upon the auxiliary drive axle assembly to a nonuse state underneath the railcar mover.

BRIEF DESCRIPTION OF THE DRAWINGS

The present invention is illustrated by way of example and not limited in the accompanying figures in which like reference numerals indicate similar elements and in which.

Figure 1:
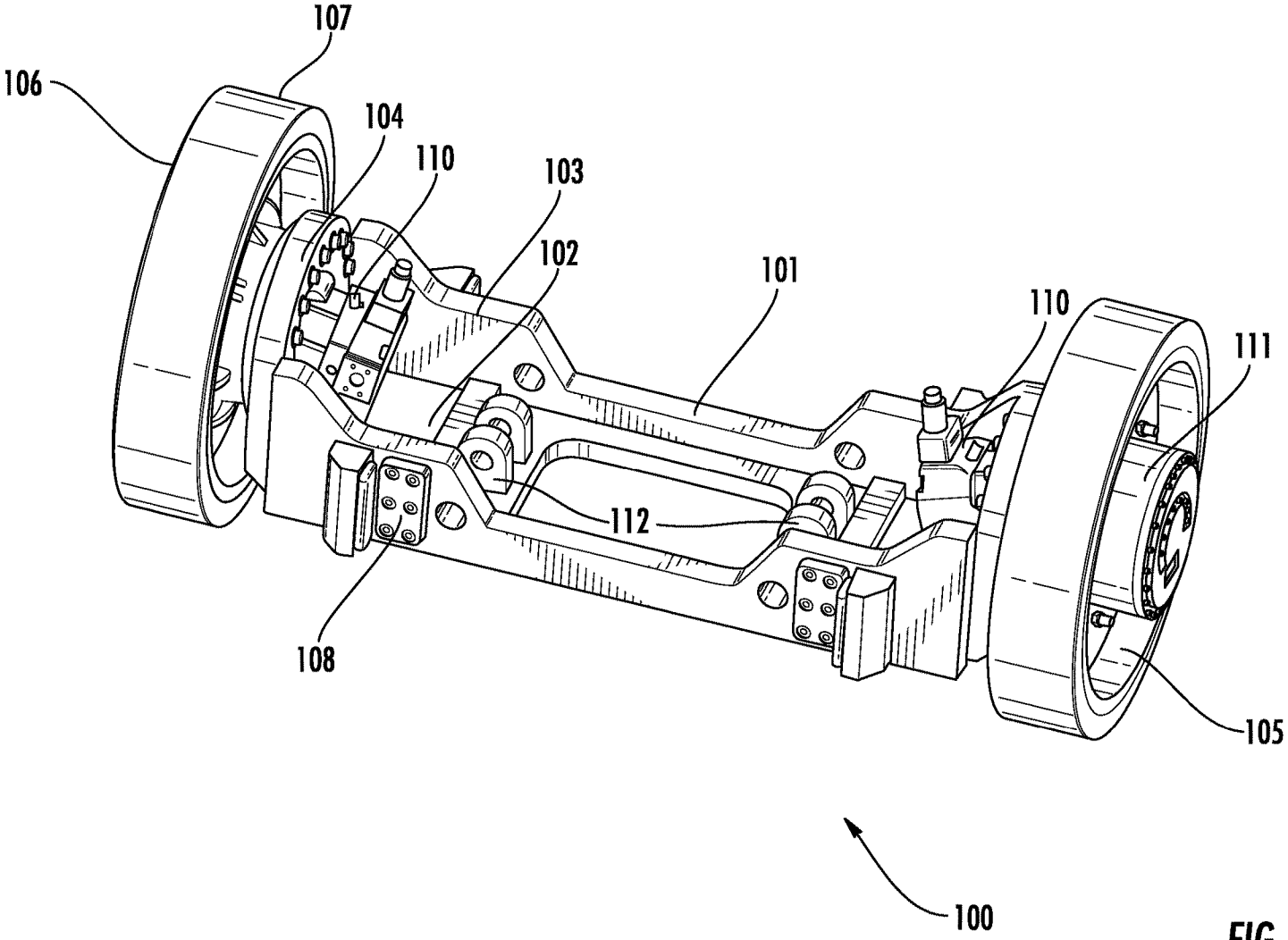
FIG. 1 depicts an isometric view of an example auxiliary drive axle assembly, according to one or more aspects described herein.

Further, it is to be understood that the drawings may represent the scale of different components of one single embodiment; however, the disclosed embodiments are not limited to that particular scale.

DETAILED DESCRIPTION

Aspects of this disclosure relate to an auxiliary drive axle assembly (ADAA) for use with a railcar mover that comprises a structural frame, a plurality of hydraulic wheel drive motors, a plurality of wheel assemblies, a plurality of gearboxes, a controller, and a plurality of sensors. The ADAA may be mounted underneath a railcar mover and stored in a retracted or non-use position when not needed by the railcar mover based upon a predetermined set of parameters. When the ADAA is needed to increase traction for the railcar mover, the ADAA may be lowered, where the ADAA wheel assemblies contact the rails, upon demand by an operator or automatically based upon the predetermined set of parameters. By adding an additional set of wheel assemblies, the ADAA may help to increase the traction of the railcar mover. The ADAA may be lowered or raised via a pump supply from the railcar mover's original hydraulic system. By adding an additional set of wheel assemblies, the ADAA may help to increase the traction of the railcar mover.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Plurality" indicates any number greater than one, either disjunctively or conjunctively, as necessary, up to an infinite number.

"Substantially constant" when referring to a dimension means that a value is approximately the same and varies no more than +/−5%.

"Integral joining technique" or means a technique for joining two pieces so that the two pieces effectively become a single, integral piece, including, but not limited to, irreversible joining techniques, such as welding, brazing, adhesively joining, cementing, or the like, where separation of the joined pieces cannot be accomplished without structural damage thereto. Pieces joined with such a technique are described as "integrally joined."

In the following description of the various embodiments, reference is made to the accompanying drawings, which form a part hereof, and in which is shown, by way of illustration, various embodiments in which aspects of the disclosure may be practiced. It is to be understood that other embodiments may be utilized and structural and functional modifications may be made without departing from the scope and spirit of the present disclosure.

Figure 2:
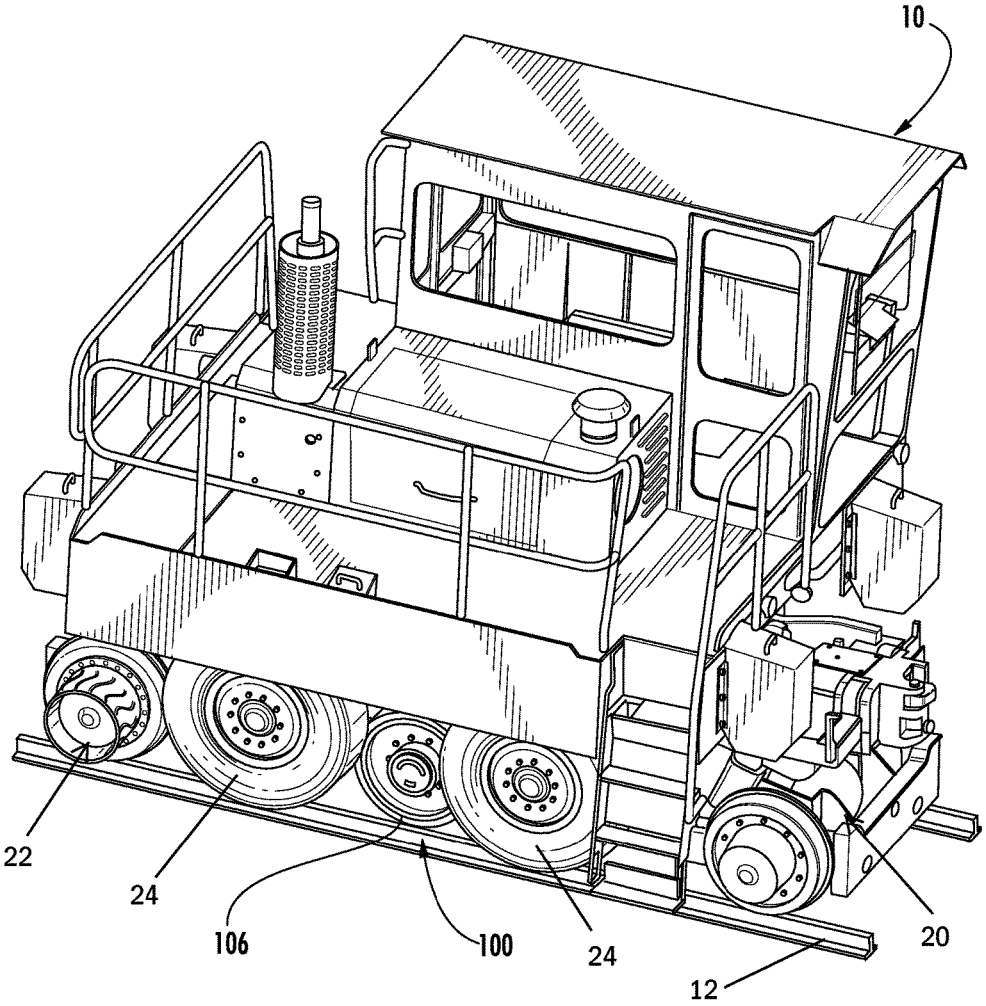
FIG. 2 depicts an isometric view of the example auxiliary drive axle assembly of FIG. 1 mounted onto a railcar mover, according to one or more aspects described herein.
Figure 3:
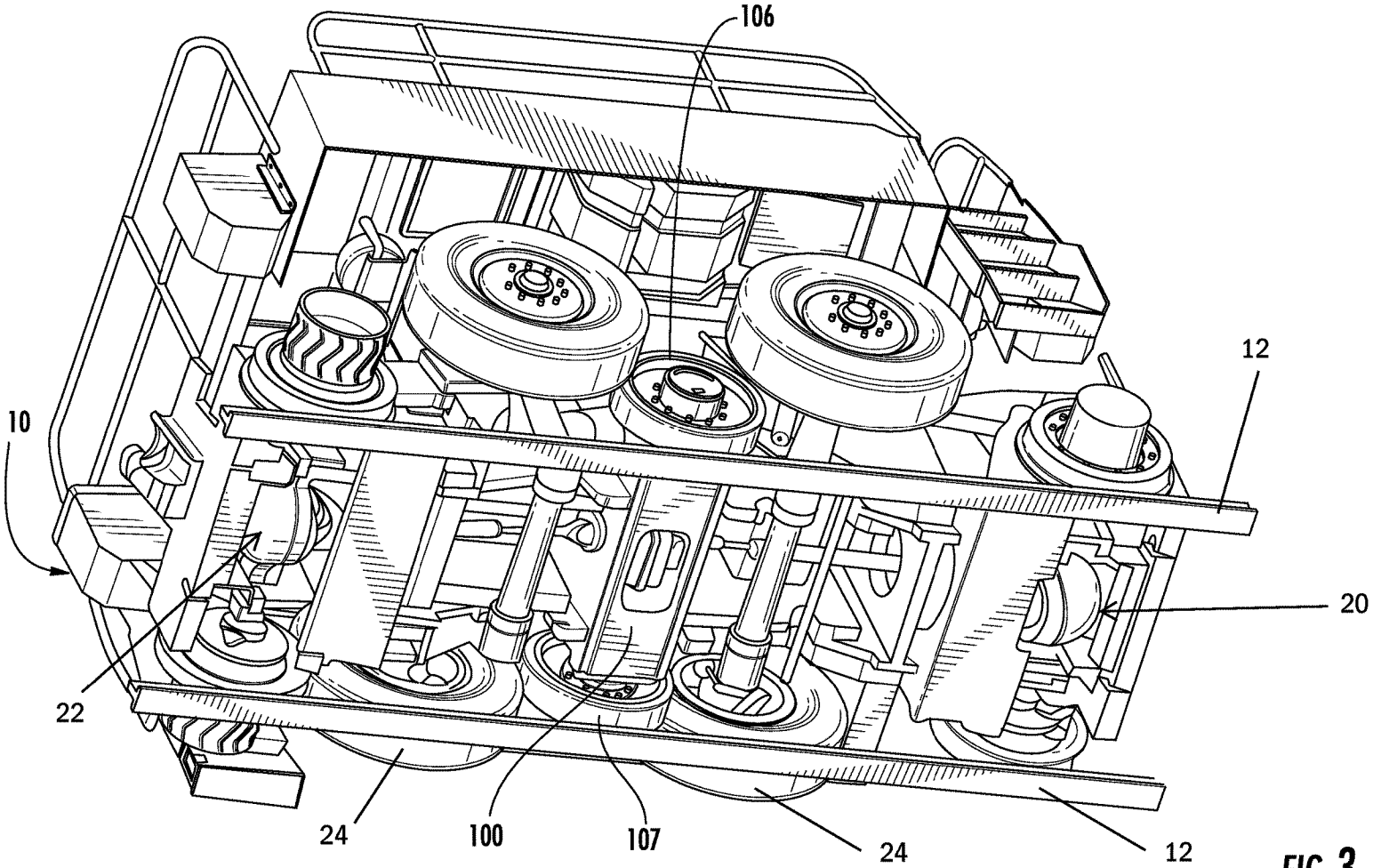
FIG. 3 depicts an isometric view of the example auxiliary drive axle assembly of FIG. 1 mounted onto a railcar mover, according to one or more aspects described herein.

FIG. 1 depicts an isometric view of an example auxiliary drive axle assembly (ADAA) 100, according to one or more aspects described herein. FIGS. 2 and 3 show isometric views of an example embodiment of the ADAA 100 connected to a railcar mover 10. As illustrated in FIGS. 2 and 3, the railcar mover 10 may include a first drive axle assembly 20 and a second drive axle assembly 22 that provide the main traction and movement for the railcar mover 10. The first drive axle assembly 20 and the second drive axle assembly 22 may include a set of rail wheel assemblies that engage the rails 12 during operation of the railcar mover 10. The first drive axle assembly 20 and the second drive axle assembly 22 may include drive motors, wheel assemblies, and gearboxes as known and used in the art. The railcar mover 10 may also include one or more pairs of road wheels 24 and road wheel drive axle assemblies that may be utilized for the railcar mover 10 when the railcar mover is moving along the road or ground and not on the rails 12. The first drive axle assembly 20 and the second drive axle assembly 22 may be raised when the railcar mover 10 is moving along the ground and not on the rails 12.

The ADAA 100 may be mounted to the underside of the railcar mover 10 proximate the center of the railcar mover 10. The ADAA 100 may comprise comprising a structural frame 101, a plurality of hydraulic pumps 122 (not shown in FIG. 1), a plurality of hydraulic wheel drive motors 110, a plurality of wheel assemblies 106, and a plurality of gearboxes 111.

The structural frame 101 may have a first end and a second end with a base wall 102 and a plurality of side walls 103 positioned between each end. The side walls 103 may have a height taller than the base wall 102 to give the frame 101 a substantially U-shaped cross-section to increase the stiffness of the frame 101. A mounting structure 104 may be positioned near each end and configured to support a hydraulic drive motor 110. An opening may be positioned near the center of the base wall 102 to help reduce the weight of the frame 101 and to allow clearance for the transfer case of the railcar mover 10. A plurality of lugs 112 may be located on the base wall 102. The frame 101 has adequate stiffness and strength to support the system while keeping the weight from being too heavy.

The structural frame 101 may be a metallic material such as a steel alloy or similar material. The frame 101 may be made as a unitary piece formed of conventional means such as a casting, forging, or machining process or formed of a plurality of components connected together and integrally joined. Alternatively, the plurality of components forming the frame 101 may be releasably connected or be connected using a combination of both releasable and integral joining techniques.

A plurality of variable displacement hydraulic (hydrostatic) wheel drive motors 110 may be connected to the mounting structures 104 near each end of the frame 101. The hydraulic wheel drive motors 110 may be releasably connected to the frame 101. Each of the motors 110 may be connected to a hydraulic pump 122 via hydraulic lines 124 that transmit the hydraulic fluid to power the motors 110. The hydraulic wheel drive motors may be capable of running at variable speeds. Additionally, each motor 110 may be connected to a wheel assembly 106 via a gearbox 111, where the number of hydraulic wheel drive motors 110 may be equal to the number of wheel assemblies 106. Alternatively, the ADAA 100 may comprise a number of hydraulic wheel drive motors 110 that may be different than the number of wheel assemblies 106.

The ADAA 100 may comprise a plurality of gearboxes 111. Each gearbox 111 may be connected to a hydraulic motor 110 and a wheel assembly 106. The gearbox 111 may have a gear ratio necessary to provide the desired amount of torque depending upon the motor 110. A portion of the gearbox 111 may be positioned within the diameter of the wheel assembly 106. Any type of gearbox 111 may be used to transfer the power from the motor 110 to the wheel assemblies 106 to provide the proper torque to the wheel assemblies. For example, the gearbox 111 may comprise a planetary-type gearbox because of its compact size and relatively low weight.

In the example embodiment of FIG. 1, each wheel assembly 106 may have an outer diameter sized to be the most effective to work in combination with the hydraulic motor 110 and gearbox 111 to provide the optimal torque and speed requirements. Additionally, the wheel assemblies 106 may be sized to fit within the existing structure of the railcar mover 10. For example, the outer diameter of the each wheel assembly 106 may be approximately 28 inches, or within a range of 24 inches to 38 inches. The wheel assembly 106 may comprise at least a wheel 105 and a tire 107. The wheel 105 may be positioned on the interior of the wheel assembly 106 with the tire 107 positioned on the exterior of the wheel assembly 106 such that the tire 107 contacts the rail when the ADAA 100 is lowered into a use position. The wheel assemblies 106 may be positioned at each end of the ADAA 100 extending beyond the frame 101.

Each wheel 105 and tire 107 may be made of a metallic material such as a steel alloy or material of similar stiffness and strength. The wheel 105 and tire 107 may be made of the same material or alternatively out of different materials. The components of the wheel assemblies 106 may be made from conventional processes, but not limited to such as casting, machining, or forging or some combination of processes. Alternatively, the entire wheel assembly 106 may be made of unitary construction, such that it was made in one piece.

The exterior surface of the tire 107 may be a smooth or may have a flange on one side like a conventional railroad car wheel. Additionally, the exterior surface of the tire 107 may have an angle or taper when measured relative to a centerline of the wheel assembly 106.

As previously discussed, each wheel assembly 106 may be powered by an individual hydraulic wheel drive motor 110 where the hydraulic wheel drive motor 110 is connected to a hydraulic pump 122 powered by an engine of the railcar mover 10. The transmission of the railcar mover 10 may allow the engine torque to be applied to power both the conventional drive train of the railcar mover 10 along with the ADAA. The transmission of the railcar mover 10 may have a power take-off (PTO) to supply power to the hydraulic pump 122. The ADAA may be considered a parasitic load to the engine of the railcar mover 10. The power to the ADAA may be before or after the engine torque is sent to the transmission. Additionally, the engine torque may be clipped electronically to control the amount of power provided to the transmission of the railcar mover 10.

By having each wheel assembly 106 powered by an individual hydraulic drive motor 110, the traction of each individual wheel assembly may be controlled. Controlling the traction to each individual wheel assembly 106 may help to prevent tire 107 wear by limiting the slip of the tires by recognizing when any slip may occur and adjusting the torque applied to the wheel assembly 106. An electronic control system may monitor control the power applied to the wheel assemblies 106.

A plurality of wear guides 108 may be positioned on the exterior of the side walls 103 of the frame 101. The wear guides 108 may help to reduce friction between the ADAA and the railcar mover 10 when the ADAA is engaged. By reducing the friction, the wear guides 108 may decrease the variation in the downward force required for the auxiliary force to engage the ADAA. The wear guides 108 are removable and replaceable units secured to the frame 101 with a plurality of fasteners to enable field replacement.

The ADAA 100 may have an electronic control system to automatically engage the ADAA 100 when required. The control system may comprise a plurality of monitoring devices to provide information regarding the parameters of various components of the railcar mover and of the ADAA 100. To determine when the ADAA 100 may be needed by the railcar mover 10 to improve traction, the control system may monitor a first set of parameters. For example, the first set of parameters may include at least one or a combination of but not limited to: the vehicle ground speed, the current operational mode of the railcar mover, the system diagnostics fault mode, the engine rpm, the torque converter rpm, the driving torque, and the input from the traction control wheel. When the values of this first set of parameters reach designated target values either individually or in combination, the control system may lower the ADAA 100 to allow the wheel assemblies to contact a set of rails 12.

Once the wheel assemblies are in contact with the rails 12, the control system may monitor a second set of parameters to determine how much power to apply to the hydraulic wheel motors 110 and the appropriate downward force to apply to the ADAA 100 to keep proper amount of pressure on the wheel assemblies 106. This downward force to apply to the ADAA 100 may be a fixed pressure and may be within a range of 650 psi to 1000 psi. Alternatively, the downward force to apply to the ADAA 100 may be an adjustable pressure within a range of 650 psi and 1000 psi. These parameters may be similar to the first set, but may also include the available engine torque, the joystick position (or operator's input), and the percent request monitoring parameters of the ADAA 100 such as sensors for the hydraulic pump 122 and the hydraulic wheel drive motors 110. Additionally, as the vehicle is able to increase speed because of the improved traction provided by the ADAA 100, the control system may adjust the force applied to the motors to maintain the optimal traction.

Lastly, the control system may monitor a third set of parameters such that when the third set of parameters reaches a predetermined set of values either individually or in combination, the control system may retract the ADAA 100 into a non-use state keeping the wheel assemblies from touching the rails 12. This third set of parameters may be similar to the first or second set of parameters and may also include: the status of the emergency stop input.

Additionally, if a braking system or brakes are applied while the ADAA 100 is in the use position, the control system may suspend power temporarily to the wheel assemblies to allow them to "freewheel."

Figure 4:
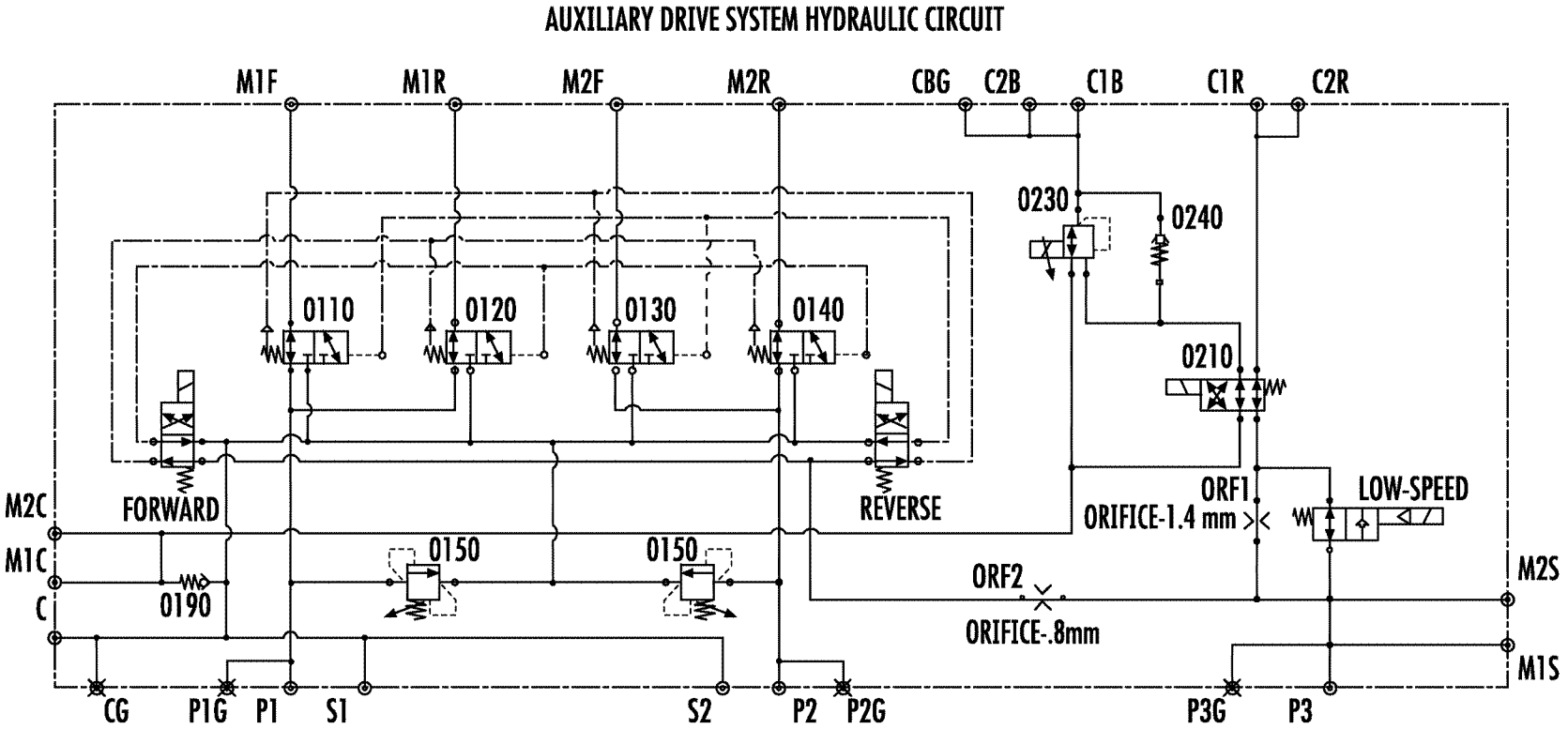
FIG. 4 depicts a schematic of the hydraulic circuit of the example auxiliary drive axle assembly of FIG. 1, according to one or more aspects described herein.

FIG. 4 shows an example hydraulic circuit of an embodiment of FIG. 1. All of the drive system hydraulic pumps and motors controls have electronic controls for precision control of system. The hydraulic circuit is a closed loop system with an external open loop charge pump circuit used to supply make up oil for losses and cooling for the closed loop system. The hydrostatic pumps 122 are equipped with a pressure control sensor 126 and a displacement control sensor 128 and variable displacement motors 110 have rpm sensors 140 and displacement controls 138 that feed. The hydraulic system may include a proportional pressure reducing valve that may control electronically to precisely control the downward force of the auxiliary drive system to the rail.

Figure 5:
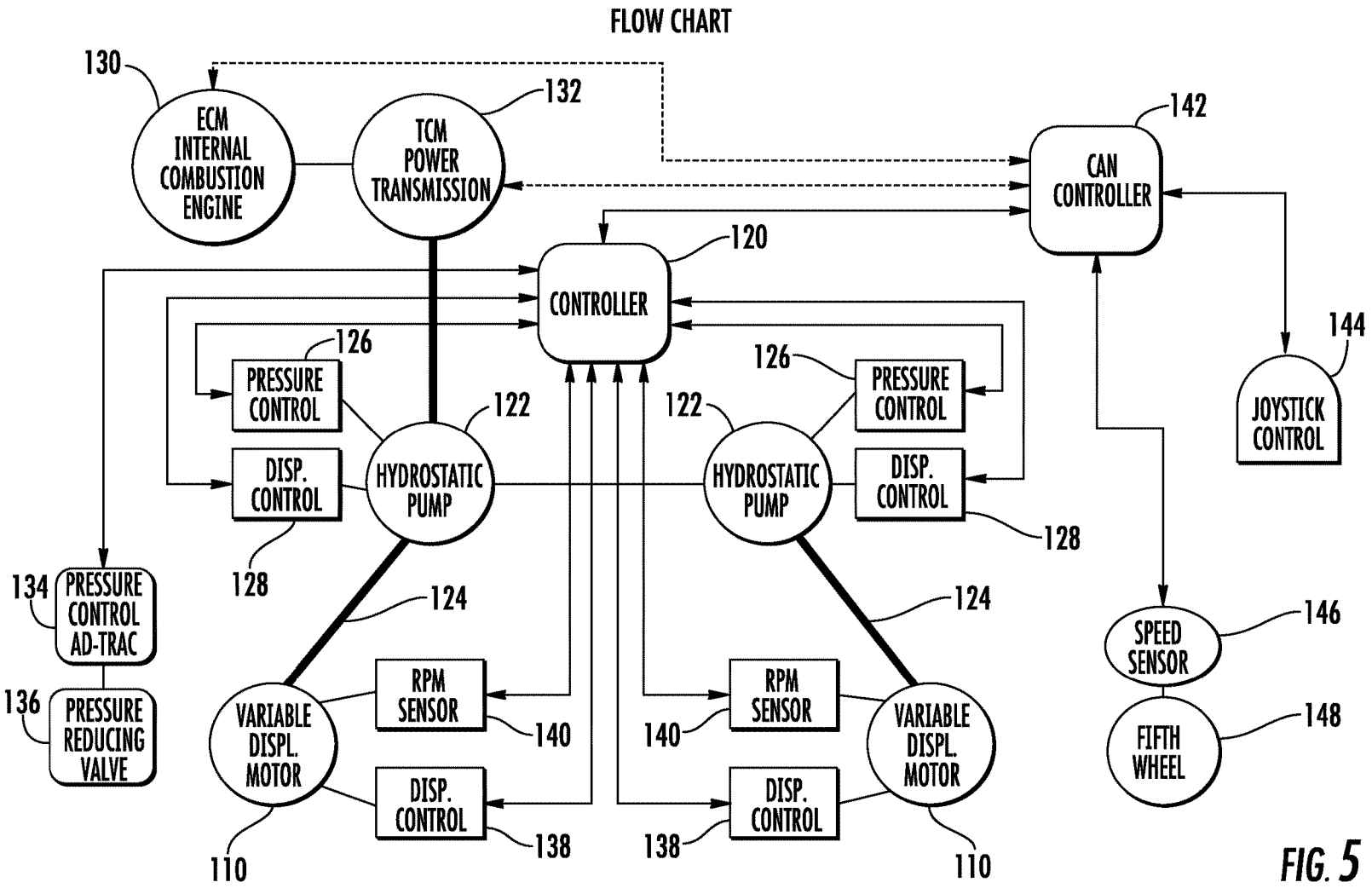
FIG. 5 depicts a schematic of the flowchart of the control system of the example auxiliary drive axle assembly of FIG. 1, according to one or more aspects described herein.

FIG. 5 shows an example flowchart of the operation of the ADAA 100 and the ADAA control system. The ADAA control system may comprise an ADAA controller 120, a plurality of valves, and a plurality of sensors. The ADAA controller 120 may be in communication with a plurality of sensors associated with the ADAA 100 such as sensors 126, 128 for monitoring the pressure and displacement of the hydraulic pumps 122, sensors 138, 140 for monitoring the rpm and displacement for the hydraulic wheel drive motors 110, and sensors for monitoring the pressure on the system to engage and retract the ADAA 100. Additionally, the controller 120 may communicate with a plurality of valves to control the hydraulic fluid flow from the hydraulic pumps 122, to the wheel motors 110, and to the system to engage and retract the ADAA 100.

Additionally, the ADAA controller 120 may communicate with a CAN controller 142, which may be an internal communications network within the railcar mover that connects to an engine control module (ECM) 130, a transmission control module (TCM) 132, a speed sensor 146 on the "fifth wheel" 148, and a joystick control 144 used by the railcar mover operator. The CAN controller 142 allows microcontrollers and other devices within the railcar mover 10 to communicate without a main computer. By communicating with the CAN controller 142, the ADAA controller 120 may receive data such as the engine rpm, torque converter rpm, driving torque, braking system and input from the traction control wheel. As previously described, by comparing the data received about the railcar mover's performance to a first predetermined set of parameters, the ADAA controller 120 may determine to lower the ADAA 100 into a use position with the wheel assemblies in contact with the rails 12 to improve the traction of the railcar mover. Additionally, when the ADAA 100 is in a use position, the ADAA controller 120 will retract the ADAA 100 into a retracted or non-use position when the data it receives from the railcar mover meets another set of predetermined parameters. The retracted position may be defined with the plurality of wheel assemblies 106 not engaging the rails 12 while the use position may be defined with the plurality of wheel assemblies 106 engaging the rails 12.

According to one aspect, an auxiliary drive axle assembly for a railcar mover may comprise a structural frame, a plurality of hydraulic wheel drive motors, a plurality of wheel assemblies, and a plurality of gearboxes. Each wheel may be powered by an individual hydraulic wheel drive motor where the hydraulic wheel drive motor is connected to the power source of the railcar mover. The hydraulic wheel drive motors may be powered by the engine of the railcar mover.

According to other aspects of invention, the auxiliary drive axle assembly (ADAA) may have a control system comprising a controller and a plurality of sensors to manage and control the operation of the auxiliary drive axle assembly. The ADAA may be lowered into a use position upon demand by the operator or lowered automatically by a control system from a retracted position underneath the railcar mover when it senses a need for additional traction based upon a first set of monitored parameters, such as engine revolutions per minute (rpm), torque converter rpm, driving torque, braking system, and input from the traction control wheel. The ADAA may be lowered or raised via a pump supply from the railcar mover's original hydraulic system. Once the axle assembly is lowered, the control system may monitor a second set of parameters to determine the proper force to be applied to the hydraulic wheel drive motors in order to achieve optimal traction. Once the system is engaged, the wheel assemblies may enter a freewheeling condition when the braking system or brakes are applied. The axle assembly may retract upon demand of the operator or automatically to a nonuse state when the conditions for a third set of parameters, such as wheel speed, driving torque, and braking are satisfied.

The control system may also comprise a non-transitory computer readable medium storing computer readable instructions that, when executed by the controller, may cause the controller perform a plurality of instructions to manage the ADAA 100. For example, the controller may acquire and compare a first set of data from the sensors to a first set of predetermined parameters. The first set of data acquired may include at least one or a combination of but not limited to: the vehicle ground speed, the current operational mode of the railcar mover, the system diagnostics fault mode, the engine speed, the torque converter speed, the driving torque, and the input from the traction control wheel. The predetermined set of parameters may include designated target values of at least one or a combination of but not limited to: the vehicle ground speed, the current operational mode of the railcar mover, the system diagnostics fault mode, the engine speed, the torque converter speed, the input from the traction control wheel, and the hydraulic system switch position. Some examples of target values for the predetermined parameters may be: the vehicle engine speed may be within the full engine range of rpm, the torque converter may be within the full torque converter range of rpm, the input from the traction control wheel may be within a range of 1.7 mph to 2.0 mph or may be within a range of 1.3 to 2.4 mph, the current vehicle operational mode may be within "Rail Mode," and the hydraulic system may be enabled to deploy the axle. Upon the first set of predetermined parameters being satisfied by the values of this first set of acquired data reaching designated the target values either individually or in combination, the controller may instruct to lower the ADAA 100 from a retracted position to a use position where the wheel assemblies to contact the rails 12.

Additionally, once the ADAA 100 is lowered into a use position, the controller may acquire a second set of data from the sensors and compare it to a second set of predetermined parameters. The second set of data acquired may include at least one or a combination of but not limited to: the vehicle ground speed, the current operational mode of the railcar mover, the system diagnostics fault mode, the vehicle engine speed, the torque converter speed, the driving torque, the input from the traction control wheel, the available engine torque, the joystick position (or operator's input), the information from the ADAA sensors for the hydraulic pump 122 and the hydraulic wheel drive motors 110. The second set of predetermined parameters may include designated target values of at least one or a combination of but not limited to: the vehicle ground speed, the current operational mode of the railcar mover, the system diagnostics fault mode, the vehicle engine speed, the torque converter speed, the driving torque, the input from the traction control wheel, the available engine torque, the joystick position (or operator's input), the information from the ADAA sensors for the hydraulic pump 122 and the hydraulic wheel drive motors 110. Some examples of target values for the predetermined parameters may comprise, but not limited to: the vehicle ground may be an adjustable value, but may be within a range of 0.1 mph and 3.0 mph, and the calculated tractive effort may be within a range of 60% to 80% of maximum calculated tractive effort to initiate the process to increase power to wheels. After comparing the second set of data to the second set of predetermined parameters, the controller may determine the proper force to be applied to the plurality of hydraulic wheel drive motors in order to achieve optimal traction.

As another aspect, once the ADAA 100 is lowered into a use position, the controller may acquire the third set of data from the sensors and compare it to a third set of predetermined parameters. The third set of data acquired may include at least one or a combination of but not limited to: the vehicle ground speed, the current operational mode of the railcar mover, the system diagnostics fault mode, the vehicle engine speed, the torque converter speed, the driving torque, the input from the traction control wheel, the available engine torque, the joystick position (or operator's input), the information from the ADAA sensors for the hydraulic pump 122, the hydraulic wheel drive motors 110 and the vehicle's status of the emergency stop input. The third set of predetermined parameters may include designated target values of at least one or a combination of but not limited to: the vehicle ground speed, the current operational mode of the railcar mover, the system diagnostics fault mode, the vehicle engine speed, the torque converter speed, the driving torque, the input from the traction control wheel, the available engine torque, the joystick position (or operator's input), the information from the ADAA sensors for the hydraulic pump 122, the hydraulic wheel drive motors 110, and the vehicle's status of the emergency stop input. Some examples of target values for the predetermined parameters may comprise, but not limited to: the vehicle ground may be an adjustable value set by the user, but may be within a range of 0.1 mph and 3.0 mph. After comparing the third set of data to the third set of predetermined parameters, the controller may instruct to retract the auxiliary drive axle assembly to a nonuse state underneath the railcar mover.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure. Thus, the spirit and scope of the invention should be construed broadly as set forth in the appended claims.

We claim:

1. An auxiliary drive axle assembly for a railcar mover comprising:

a structural frame;

a plurality of hydraulic wheel drive motors;

a plurality of wheel assemblies, wherein each wheel assembly is powered by one of the plurality of hydraulic wheel drive motors and wherein each hydraulic wheel drive motor is connected to a power source of the railcar mover; and a plurality of gearboxes, wherein the structural frame and auxiliary drive axle assembly is positioned underneath the railcar mover and provides traction assistance to the railcar mover by being lowered from a retracted position to a use position, wherein the retracted position is defined where the plurality of wheel assemblies do not engage a set of rails and the use position is defined where the plurality of wheel assemblies engage the set of rails;

wherein the auxiliary drive axle assembly includes a control system comprising a controller and a plurality of sensors to control the auxiliary drive axle assembly; and a non-transitory computer readable medium storing computer readable instructions that, when executed by the controller, causes the controller to at least:

acquire, by the plurality of sensors, a first set of data comprising: engine revolutions per minute;

compare the first set of data to a first set of predetermined parameters; and upon determining that first set of predetermined parameters is satisfied, instruct to lower the auxiliary drive axle assembly into the use position from the retracted position underneath the railcar mover; and wherein the first set of predetermined parameters includes designated target values of at least engine revolutions per minute.

2. The auxiliary drive axle assembly of claim 1, wherein an outer diameter of each of the plurality of wheel assemblies is within a range of 24 inches to 38 inches.

3. The auxiliary drive axle assembly of claim 1, wherein the first set of data further comprises: a torque converter rpm, a driving torque, input from a braking system, and input from a traction control wheel.

4. The auxiliary drive axle assembly of claim 1, wherein the non-transitory computer readable medium stores computer readable instructions that, when executed by the controller, further causes the controller to at least:

upon lowering the auxiliary drive axle assembly into the use position;

acquire, by the plurality of sensors, a second set of data including engine revolutions per minute;

compare from the second set of data to a second set of predetermined parameters; and determine a proper force to be applied to the plurality of hydraulic wheel drive motors in order to achieve optimal traction.

5. The auxiliary drive axle assembly of claim 4, wherein the second set of data further comprises: a torque converter rpm, a driving torque, input from a braking system, and input from a traction control wheel.

6. The auxiliary drive axle assembly of claim 4, wherein the non-transitory computer readable medium stores computer readable instructions that, when executed by the controller, further causes the controller to at least:

upon lowering the auxiliary drive axle assembly into the use position, acquire, by the plurality of sensors, a third set of data including engine revolutions per minute;

compare from the third set of data to a third set of predetermined parameters; and upon determining that the third set of predetermined parameters are satisfied, instruct to retract the auxiliary drive axle assembly to a nonuse state underneath the railcar mover;

wherein the third set of predetermined parameters includes designated target values of at least engine revolutions per minute.

7. The auxiliary drive axle assembly of claim 1, wherein the structural frame and the auxiliary drive axle assembly is lowered from the retracted position underneath the railcar mover using a pump supply from a hydraulic system from the railcar mover.

8. An auxiliary drive axle assembly for a railcar mover comprising:

a structural frame having a first end and a second end and a plurality of side walls positioned between each end, a first hydraulic wheel drive motor, a first gearbox, and a first wheel assembly positioned at the first end of the structural frame; and a second hydraulic wheel drive motor, a second gearbox, and a second wheel assembly positioned at the second end of the structural frame, wherein the first wheel assembly is connected to the first hydraulic wheel drive motor via the first gearbox; and the second wheel assembly is connected to the second hydraulic wheel drive motor via the second gearbox;

wherein the auxiliary drive axle assembly is positioned underneath the railcar mover, wherein the auxiliary drive axle assembly includes a control system comprising a controller and a plurality of sensors to control the auxiliary drive axle assembly, and a non-transitory computer readable medium storing computer readable instructions that, when executed by the controller, causes the controller to at least:

acquire, by the plurality of sensors, a first set of data comprising: engine revolutions per minute;

compare the first set of data to a first set of predetermined parameters; and upon determining that first set of predetermined parameters is satisfied, instruct to lower the auxiliary drive axle assembly into a use position from a retracted position underneath the railcar mover; and wherein the first set of predetermined parameters includes designated target values of at least engine revolutions per minute.

9. The auxiliary drive axle assembly of claim 8, wherein a portion of the first gearbox is positioned within a diameter of the first wheel assembly.

10. The auxiliary drive axle assembly of claim 8, wherein an outer diameter of each of the first wheel assembly is within a range of 24 inches to 38 inches.

11. The auxiliary drive axle assembly of claim 8, wherein a plurality of wear guides are positioned on an exterior surface of the plurality of side walls of the structural frame and wherein the wear guides are removable.

12. The auxiliary drive axle assembly of claim 8, wherein the first wheel assembly comprises: a first wheel on an interior of the first wheel assembly and a first tire positioned on an exterior of the first wheel assembly, wherein the first tire includes a taper on an exterior surface, and wherein the second wheel assembly comprises: a second wheel on an interior of the second wheel assembly and a second tire positioned on an exterior of the second wheel assembly, wherein the second tire includes a taper on an exterior surface.

13. The auxiliary drive axle assembly of claim 8, wherein the first wheel assembly is powered by the first hydraulic wheel drive motor, and the second wheel assembly is powered by the second hydraulic wheel drive motor, and wherein the first hydraulic wheel drive motor and the second hydraulic wheel drive motor are connected to a power source of the railcar mover.

14. An auxiliary drive axle assembly for a railcar mover comprising:

a structural frame having a first end and a second end and a plurality of side walls positioned between each end, a first hydraulic wheel drive motor, a first gearbox, and a first wheel assembly positioned at the first end of the structural frame;

a second hydraulic wheel drive motor, a second gearbox, and a second wheel assembly positioned at the second end of the structural frame, a control system comprising a controller and a plurality of sensors to control the auxiliary drive axle assembly;

wherein an outer diameter of each of the first wheel assembly and the second wheel assembly is within a range of 24 inches to 38 inches;

wherein the first wheel assembly is powered by the first hydraulic wheel drive motor, and the second wheel assembly is powered by the second hydraulic wheel drive motor, and wherein the first hydraulic wheel drive motor and the second hydraulic wheel drive motor are connected to a power source of the railcar mover;

wherein the auxiliary drive axle assembly is positioned underneath the railcar mover; and a non-transitory computer readable medium storing computer readable instructions that, when executed by the controller, causes the controller to at least:

acquire, by the plurality of sensors, a first set of data comprising: engine revolutions per minute:

compare the first set of data to a first set of predetermined parameters; and upon determining that first set of predetermined parameters is satisfied, lower the auxiliary drive axle assembly into a use position from a retracted position underneath the railcar mover, wherein the retracted position is defined where the first wheel assembly and the second wheel assembly are not engaging a set of rails and the use position is defined where first wheel assembly and the second wheel assembly engage the set of rails.

15. The auxiliary drive axle assembly of claim 14, wherein the non-transitory computer readable medium stores computer readable instructions that, when executed by the controller, further causes the controller to at least:

upon lowering the auxiliary drive axle assembly into the use position;

acquire, by the plurality of sensors, a second set of data including engine revolutions per minute;

compare from the second set of data to a second set of predetermined parameters; and determine a proper force to be applied to the first hydraulic wheel drive motor and the second hydraulic wheel drive motor in order to achieve optimal traction.

16. The auxiliary drive axle assembly of claim 15, wherein the non-transitory computer readable medium stores computer readable instructions that, when executed by the controller, further causes the controller to at least:

upon lowering the auxiliary drive axle assembly into the use position;

acquire, by the plurality of sensors, a third set of data including engine revolutions per minute;

compare from the third set of data to a third set of predetermined parameters; and upon determining that the third set of predetermined parameters are satisfied, instruct to retract upon the auxiliary drive axle assembly to a nonuse state underneath the railcar mover.

* * * * *